United States Patent [19]

Wachtel

[11] Patent Number: 4,566,145

[45] Date of Patent: Jan. 28, 1986

[54] HAIRBRUSH

[75] Inventor: Jean-Louis Wachtel, Selestat, France

[73] Assignee: Celluloid S.A., France

[21] Appl. No.: 622,274

[22] Filed: Jun. 19, 1984

[30] Foreign Application Priority Data

Jun. 23, 1983 [FR] France ..... 83 10415

[51] Int. Cl.[4] ..... A46B 1/00; A46B 15/00

[52] U.S. Cl. ..... 15/201; 15/187; 15/159 A; 132/85; 132/144

[58] Field of Search ..... 15/201, 160, 159 A, 15/186, 187, 188, 106; 132/85, DIG. 1, 138, 139, 144

[56] References Cited

U.S. PATENT DOCUMENTS

| | | | |
|---|---|---|---|
| 2,748,783 | 6/1956 | Lachance | 132/155 |
| 3,253,292 | 5/1966 | Herchensohn | 15/201 |
| 4,404,977 | 9/1983 | Vasas | 15/159 A |
| 4,486,915 | 12/1984 | Stewart et al. | 15/187 |

FOREIGN PATENT DOCUMENTS

| | | | |
|---|---|---|---|
| 71971 | 6/1978 | Japan | 15/187 |

*Primary Examiner*—Peter Feldman

*Attorney, Agent, or Firm*—Steinberg & Raskin

[57] ABSTRACT

The present invention relates to a hairbrush wherein the bars located on either side of the longitudinal portion connected to the handle are provided with tongues allowing the hair locks to be resiliently maintained between the tongues and the bars during the brushing.

7 Claims, 4 Drawing Figures

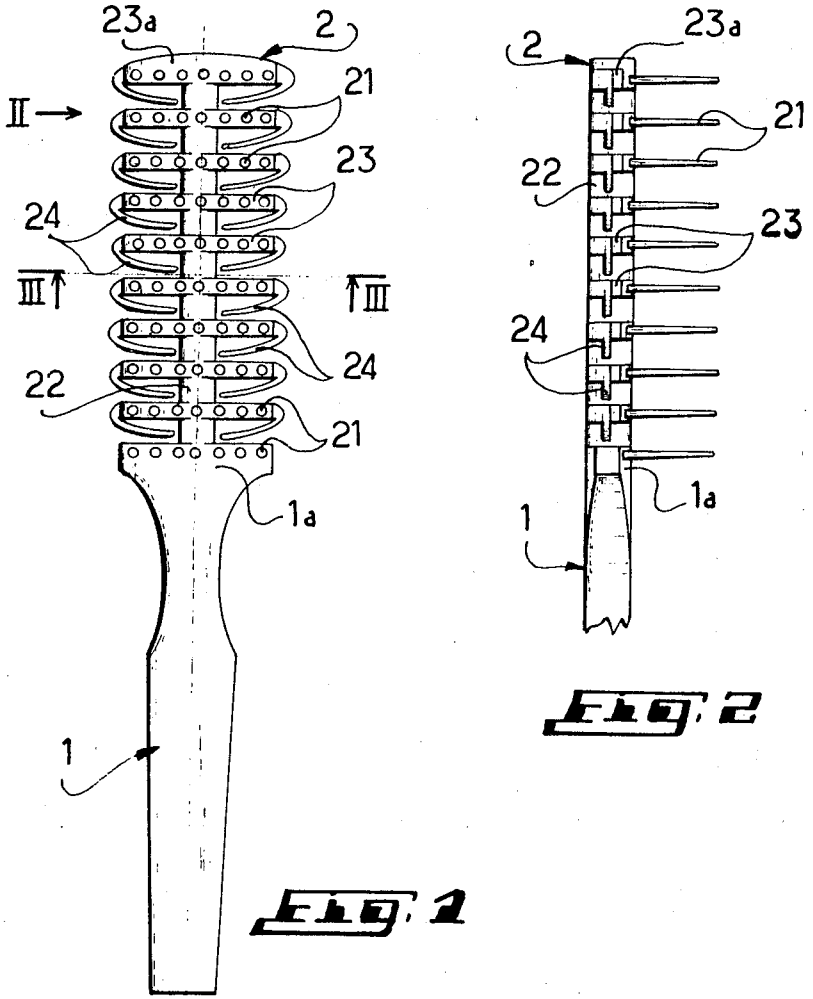
Fig. 1
Fig. 2
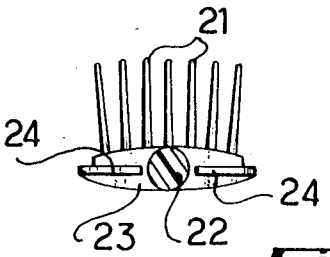
Fig. 3
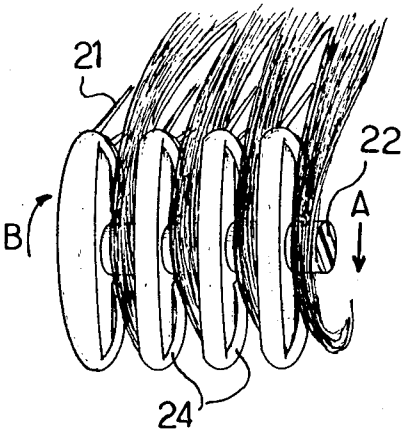
Fig. 4

HAIRBRUSH

BACKGROUND OF THE INVENTION

The present invention relates to a hairbrush for disentangling the hair, especially long hair, allowing it to be separated into several hair locks.

There are already known such hairbrushes, which include a handle to which is connected a head from one face of which protrude bristles for disentangling the hair. The head is constituted by a longitudinal portion coaxial with the handle and by several bars extending from either side and in spaced arrangement with respect to one another along the longitudinal portion with the bristles fixed to the bars.

With such a brush configuration, it is therefore possible during the brushing operation to disentangle the hair and then, by slightly turning the brush around its longitudinal axis, to separate the hair into several locks by means of the bars of the brush head, each lock being located in the space between two successive bars.

However, such brushes suffer from the disadvantage that they easily allow at least one of the separated hair locks to escape from the space between two successive bars.

SUMMARY OF THE INVENTION

The present invention has for a purpose to remedy the above disadvantage.

To this end, the present invention provides a hairbrush of the type including a handle, a head connected to the handle and from a face of which protrude pins, the said head consisting of a longitudinal portion coaxial with the handle and of several bars extending from either side of the longitudinal portion in spaced arrangement with respect to one another along the said longitudinal portion, said pins being located on the said bars, characterized in that at least some of the said bars located on a same side from the longitudinal portion include hair guiding means so shaped as to prevent the hair located between each bar from escaping during the brushing.

According to one feature of the invention, the guiding means include flexible tongues protuding in the space between two successive bars and whose free end is directed towards the longitudinal portion.

According to still another feature of the invention, each tongue starts substantially from the free end of each bar.

BRIEF DESCRIPTION OF THE DRAWINGS

For a fuller understanding of the invention, reference is made to the following description taken in conjunction with the accompanying drawings in which FIG. 1 is a front view of the hairbrush according to the invention;

FIG. 2 is a side view in the direction of arrow II of FIG. 1;

FIG. 3 is a cross-sectional view upon the line III—III of FIG. 1; and

FIG. 4 is a perspective view of the upper end of the head of the brush of FIG. 1, showing the manner in which the hair locks are maintained.

DESCRIPTION OF THE PREFERRED EMBODIMENTS

Referring to FIG. 1, there is shown a hairbrush including a handle 1 to which is connected a head portion 2 from one face of which protrude pins 21 (see also FIG. 2).

The head 2 is constituted by a longitudinal portion 22 coaxially connecting with the handle 1 and displaying, in the case considered, a circular cross-section, and by several bars 23 extending from either side of the longitudinal portion 22 in perpendicular relationship to said longitudinal portion. Bars 23 are arranged in spaced relationship to one another along the longitudinal portion 22 and thus define a space between two successive bars for the passage of hair locks during the brushing. As shown in FIGS. 1, 2 and 3, the pins 21 are located on the bars 23 located between the endmost bar 23*a* and of the head 2 and the widened portion 1*a* of the handle 1.

The brush of the described configuration may be made from plastics material and is obtained directly by casting, in which case the pins 21 are in the form of pins of flexible plastics.

According to the invention, and as shown more particularly in FIGS. 1 and 4, a flexible tongue 24 protrudes in the space between the consecutive bars 23 located on the same side of the longitudinal portion 22. The flexible tongue 24 starts substantially from the free end of each of the bars and has a free end directed towards the longitudinal portion 22, each tongue being located in the medial plane of the brush. The tongues 24, in the case considered, protrude towards the handle 1 and are substantially curvilinear. Of course, without departing from the scope of the present invention, the tongues 24 may protrude towards the endmost bar 23*a*, in which case the first tongue starts from the end of the widened portion 1*a* whereas the last tongue starts from the end of the bar 23 preceding the endmost bar 23*a*. The space between the free end of each tongue 24 and the adjacent bar may be defined as being substantially equal to the thickness of a tongue.

The function of the tongues 24 starting from each of the bars 23 will be explained below with reference particularly to FIG. 4.

During the brushing of long hair in the direction of arrow A in order to disentangle the hair, the user lightly turns the brush head around the longitudinal axis of the brush according to arrow B. Since the pins 21 are arranged along the bars 23 and spaced on the latter a distance corresponding substantially to the space between two consecutive bars, the hair is disentangled into several locks entering the space between the consecutive bars.

Each hair lock thus separated abuts against the curvilinear portion of the corresponding tongue 24 and slides along it.

After reaching a point near the free end of the tongue 24, each lock tends to bend the tongue towards its supporting bar to an extent substantially equal to the thickness of the lock.

Each hair lock is thus held between each tongue 24 and the bar 23 confronting it.

Therefore, the brush of the present invention has the property of holding the hair by nipping it. Consequently, it ensures a greater efficiency of the brushing as well as of the drying of the hair and, at the same time as the brushing function, it allows the user, such as for example a hairdresser, to additionally perform the work which, up to the present, he used to perform by using an additional comb known as the "afro" comb.

What is claimed is

1. A hairbrush including a handle, a head connected to said handle and having a face from which protrude pins for brushing the hair, said head being constituted by a longitudinal portion coaxial with said handle and by a plurality of bars extending from either side of said longitudinal portion in spaced arrangement with respect to one another along said portion, said protruding pins being located on said bars and said space defined between two consecutive bars being adapted to receive a hair lock during the brushing operation;

wherein each bar includes a flexible tongue protruding in each space between two consecutive bars located on a same side of said longitudinal portion and having a free end directed towards said longitudinal portion, each flexible tongue being arranged so as to guide therealong the hair lock into said space during the brushing operation and to hold it between its free end and the adjacent bar confronting it.

2. A brush according to claim 1, wherein each flexible tongue stats substantially from a free end of each bar.

3. A brush according to claim 2, wherein each tongue is located in the medial plane of the brush.

4. A brush according to claim 1, wherein said tongues protrude towards said handle.

5. A brush according to claim 1, wherein the space between the free end of said tongue and said adjacent bar is substantially equal to the thickness of said tongue.

6. The brush of claim 1, wherein each of said tongues is substantially curvilinear.

7. A hairbrush including a handle, a head connected to said handle and having a face from which protrude pins for brushing the hair, said head being constituted by a longitudinal portion coaxial with said handle and by a plurality of bars extending from either side of said longitudinal portion in spaced arrangement with respect to one another along said portion, said protruding pins being located on said bars and said space defined between two consecutive bars being adapted to receive a hair lock during the brushing operation;

wherein each bar includes a flexible tongue which starts substantially from a free end of said bar and protrudes in each space between two consecutive bars located on a same side of said longitudinal portion, said flexible tongue having a free end directed towards said longitudinal portion and being arranged so as to guide therealong the hairlock into said space during the brushing operation and to hold it between its free end and said adjacent bar confronting it.

* * * * *